US009531118B2

(12) United States Patent
Byrne et al.

(10) Patent No.: US 9,531,118 B2
(45) Date of Patent: Dec. 27, 2016

(54) ELECTRICAL POWER COUPLING WITH MAGNETIC CONNECTIONS

(71) Applicants: Norman R. Byrne, Ada, MI (US); Roger D. Burdi, Grand Rapids, MI (US); Marc A. Mitchell, Belmont, MI (US); Nickolas J. Morrow, Ada, MI (US)

(72) Inventors: Norman R. Byrne, Ada, MI (US); Roger D. Burdi, Grand Rapids, MI (US); Marc A. Mitchell, Belmont, MI (US); Nickolas J. Morrow, Ada, MI (US)

( * ) Notice: Subject to any disclaimer, the term of this patent is extended or adjusted under 35 U.S.C. 154(b) by 0 days.

(21) Appl. No.: 14/795,418

(22) Filed: Jul. 9, 2015

(65) Prior Publication Data

US 2016/0013582 A1 Jan. 14, 2016

Related U.S. Application Data

(60) Provisional application No. 62/022,740, filed on Jul. 10, 2014.

(51) Int. Cl.

| | |
|---|---|
| ***H01R 13/62*** | (2006.01) |
| ***H01R 13/24*** | (2006.01) |
| *H01R 25/16* | (2006.01) |

(52) U.S. Cl.

CPC ..... *H01R 13/6205* (2013.01); *H01R 13/2421* (2013.01); *H01R 25/162* (2013.01)

(58) Field of Classification Search

CPC ..... H01R 11/30; H01R 12/91; H01R 13/28; H01R 13/6205; H01R 13/6315; H01R 13/2421; H01R 25/162

(Continued)

(56) References Cited

U.S. PATENT DOCUMENTS 2,234,982 A 3/1941 Ross
2,573,920 A * 11/1951 McLeod ..... H01H 36/00 174/53

(Continued)

FOREIGN PATENT DOCUMENTS

FR 2938383 5/2010
WO 2012036713 3/2012

(Continued)

OTHER PUBLICATIONS

"MagSafe." Wikipedia, n. d. Web. Feb. 26, 2015. <http://en.wikipedia.org/wiki/MagSafe>, published on or before Feb. 23, 2015.

(Continued)

*Primary Examiner* — Neil Abrams
*Assistant Examiner* — Travis Chambers
(74) *Attorney, Agent, or Firm* — Gardner, Linn, Burkhart & Flory, LLP

(57) ABSTRACT

An electrical power coupling includes a pair of power coupling parts, each having a base and a coupling portion that is movable relative to said base. Each coupling portion has first and second electrical contacts that are spaced laterally outboard, by respective first and second distances, from centers of the coupling portions. Magnetic elements attract the respective coupling portions to one another when the coupling portions are positioned closely to one another. Each coupling portion moves relative to its respective base to align the coupling portions with one another and establish electrical connections between the first electrical contacts and between the second electrical contacts. Optionally, at least two electrical contacts are arcuate or circular in shape.

20 Claims, 15 Drawing Sheets

(58) Field of Classification Search
USPC ..... 439/39, 246–248, 38, 40
See application file for complete search history.

(56) References Cited

U.S. PATENT DOCUMENTS 3,363,214 A 1/1968 Wright
3,521,216 A * 7/1970 Tolegian ..... H01R 13/6205 439/152
3,786,391 A * 1/1974 Mathauser ..... H01R 13/6205 335/205
3,808,577 A * 4/1974 Mathauser ..... H01R 13/6205 439/180
3,810,258 A 5/1974 Mathauser
3,994,552 A * 11/1976 Selvin ..... H01R 13/523 439/278
4,004,298 A 1/1977 Freed
4,112,941 A 9/1978 Larimore
4,580,862 A * 4/1986 Johnson ..... H01R 24/52 439/248
5,037,322 A * 8/1991 Adams ..... B60C 23/02 235/103
5,071,363 A * 12/1991 Reylek ..... H01R 4/26 439/290
5,199,892 A * 4/1993 Campbell ..... H01R 13/631 361/787
5,401,175 A 3/1995 Guimond et al.
5,481,607 A * 1/1996 Hsiao ..... H04M 1/15 242/385.1
5,752,845 A * 5/1998 Fu ..... B60N 2/0224 439/247
5,909,100 A 6/1999 Watanabe et al.
5,921,783 A * 7/1999 Fritsch ..... H01R 13/44 439/38
5,954,520 A 9/1999 Schmidt
6,007,344 A * 12/1999 Corrunker ..... B60Q 1/0082 439/22
6,162,062 A * 12/2000 Liao ..... H01R 39/643 439/17
6,250,931 B1 6/2001 Mendelson
6,478,614 B1 11/2002 De'Longhi
6,497,579 B1 * 12/2002 Garbini ..... H01R 13/6315 439/246
6,508,663 B1 * 1/2003 Uusimaki ..... H01R 23/26 439/500
6,558,177 B2 * 5/2003 Havener ..... H01R 24/50 439/246
6,561,815 B1 5/2003 Schmidt
6,733,317 B2 * 5/2004 Sato ..... B41J 29/02 439/246
6,798,227 B1 * 9/2004 Hwang ..... G01R 31/2806 324/750.22
6,808,405 B1 10/2004 Uratani et al.
6,984,153 B2 1/2006 Lai et al.
7,059,882 B2 * 6/2006 Sugita ..... H01R 13/6315 439/247
7,066,739 B2 * 6/2006 McLeish ..... H01R 13/6205 439/39
7,090,521 B2 * 8/2006 Nishio ..... H01R 13/6315 439/248
7,249,960 B2 7/2007 Annecke et al.
7,264,479 B1 * 9/2007 Lee ..... H01R 11/30 439/39
7,311,526 B2 12/2007 Rohrbach et al.
7,311,541 B2 * 12/2007 Chien ..... H01R 13/748 439/246
7,344,380 B2 3/2008 Neidlein et al.
7,351,066 B2 4/2008 DiFonzo et al.
7,404,726 B1 * 7/2008 Herring ..... H01R 13/6315 439/246
7,462,066 B2 * 12/2008 Kohen ..... F21V 21/03 439/537
7,467,948 B2 12/2008 Lindberg et al.
7,500,862 B1 * 3/2009 Herring ..... H01R 13/6315 439/246
7,500,882 B2 * 3/2009 Goetz ..... H01R 13/2428 439/638
7,517,222 B2 4/2009 Rohrbach et al.
7,607,920 B1 10/2009 Chen
7,641,476 B2 1/2010 Didur et al.
7,641,477 B2 1/2010 DiFonzo et al.
7,645,143 B2 1/2010 Rohrbach et al.
7,658,612 B2 * 2/2010 Lee ..... H01R 12/592 439/37
7,658,613 B1 2/2010 Griffin
7,726,974 B2 6/2010 Shah et al.
7,741,806 B2 6/2010 Kuhlmann et al.
7,775,801 B2 8/2010 Shiff et al.
7,841,776 B2 11/2010 DiFonzo et al.
7,841,865 B2 * 11/2010 Maughan ..... H01R 13/2421 439/66
7,901,216 B2 3/2011 Rohrbach et al.
7,963,774 B2 6/2011 Shiff et al.
8,022,664 B2 9/2011 Shu
8,087,939 B2 1/2012 Rohrbach et al.
8,105,091 B2 1/2012 Nishihira et al.
8,143,983 B1 3/2012 Lauder et al.
8,177,560 B2 5/2012 Rohrbach et al.
8,242,868 B2 8/2012 Lauder et al.
8,251,705 B2 8/2012 Nishihira et al.
8,366,469 B2 * 2/2013 Carnevali ..... G06F 1/1632 439/248
8,382,486 B2 2/2013 Lee et al.
8,398,409 B2 * 3/2013 Schmidt ..... H01R 11/30 439/39
8,410,753 B2 4/2013 Opolka
8,435,042 B2 5/2013 Rohrbach et al.
8,514,042 B2 8/2013 Lauder et al.
8,529,274 B2 9/2013 Li et al.
8,535,088 B2 9/2013 Gao et al.
8,596,881 B2 12/2013 Umeno
8,602,795 B2 * 12/2013 Hsu ..... H01R 13/6205 439/39
8,622,629 B1 1/2014 Umeno
8,651,711 B2 2/2014 Rudisill et al.
8,651,879 B2 2/2014 Stiehl et al.
8,672,228 B1 3/2014 Saini
8,690,582 B2 * 4/2014 Rohrbach ..... H01R 13/6205 439/39
8,696,366 B2 4/2014 Chen et al.
8,702,316 B2 4/2014 DiFonzo et al.
8,734,165 B2 5/2014 Neel
8,770,857 B2 7/2014 DiFonzo et al.
8,790,120 B2 7/2014 Wang et al.
8,888,500 B2 11/2014 Gao et al.
8,915,609 B1 12/2014 Shah et al.
8,992,241 B2 * 3/2015 Genest ..... H01R 13/627 439/248
9,004,930 B2 * 4/2015 Gualino ..... H01R 13/2421 439/136
2005/0082915 A1 4/2005 Steinberg
2005/0170672 A1 8/2005 Lai et al.
2006/0105603 A1 * 5/2006 Nishio ..... H01R 13/6315 439/247
2006/0152945 A1 7/2006 Lantzsch et al.
2007/0254510 A1 11/2007 DeBey
2008/0090432 A1 4/2008 Patterson et al.
2009/0239392 A1 9/2009 Sumitomo et al.
2010/0144164 A1 6/2010 Wang et al.
2011/0028006 A1 2/2011 Shah et al.
2012/0028505 A1 * 2/2012 Weber ..... H01R 25/003 439/638
2012/0177322 A1 7/2012 Schwandt et al.
2012/0177323 A1 7/2012 Schwandt et al.
2012/0177324 A1 7/2012 Schwandt et al.
2012/0177325 A1 7/2012 Schwandt et al.
2012/0183258 A1 7/2012 Schwandt et al.
2012/0183259 A1 7/2012 Schwandt et al.
2012/0183260 A1 7/2012 Schwandt et al.
2012/0183261 A1 7/2012 Schwandt et al.
2012/0183262 A1 7/2012 Schwandt et al.
2012/0189155 A1 7/2012 Gabara
2012/0206090 A1 8/2012 Hyun-Jun et al.

(56) References Cited

U.S. PATENT DOCUMENTS

2012/0252231 A1 10/2012 Kall
2012/0295451 A1 11/2012 Hyun-Jun et al.
2012/0322323 A1 12/2012 Fowler
2013/0040470 A1 2/2013 Gao et al.
2013/0050958 A1 2/2013 Bdeir
2013/0088186 A1 4/2013 Hsieh
2013/0210244 A1 8/2013 DiFonzo et al.
2013/0323941 A1* 12/2013 Zeliff ..... H01R 13/6205 439/39
2013/0343025 A1 12/2013 Bdeir
2014/0011375 A1 1/2014 Lin
2014/0049911 A1 2/2014 Corbin et al.
2014/0065846 A1 3/2014 Poh et al.
2014/0087569 A1 3/2014 Lee
2014/0087581 A1 3/2014 Umeno
2014/0099801 A1 4/2014 Liao
2014/0120746 A1 5/2014 Persion et al.
2014/0148018 A1 5/2014 Kim
2014/0153265 A1 6/2014 Rudisill et al.
2014/0162468 A1 6/2014 Kim
2014/0170864 A1 6/2014 Hwang
2014/0179126 A1 6/2014 Gao et al.
2014/0187057 A1 7/2014 Murtagian et al.
2014/0192494 A1 7/2014 Liang et al.
2015/0071675 A1* 3/2015 Suzaki ..... G03G 15/80 399/90
2015/0118868 A1* 4/2015 Choi ..... H01R 11/30 439/39

FOREIGN PATENT DOCUMENTS

WO 2012036716 3/2012
WO 2012078526 6/2012
WO 2012106215 8/2012
WO 2012158616 11/2012
WO 2013003781 1/2013
WO 2013022899 2/2013
WO 2013165049 11/2013
WO 2014010781 1/2014
WO 2014021847 2/2014
WO 2015168221 A1 11/2015

OTHER PUBLICATIONS

"Magnetic Connector Power Cord", <http://www.alibaba.com/showroom/magnetic-power-connector.html>, published on or before Feb. 26, 2015.
U.S. Appl. No. 61/985,766, filed Apr. 29, 2014.

* cited by examiner

ELECTRICAL POWER COUPLING WITH MAGNETIC CONNECTIONS

CROSS REFERENCE TO RELATED APPLICATION

The present application claims the benefit of U.S. provisional application Ser. No. 62/022,740, filed Jul. 10, 2014, which is hereby incorporated by reference in its entirety.

FIELD OF THE INVENTION

The present invention relates to electrical power and/or electronic data outlets, receptacles, and connectors for establishing establish direct electrical connections between respective electrical conductors.

BACKGROUND OF THE INVENTION

Many different types of electrical and electronic data connectors have been devised for transmitting electrical power or electrical signals from one or more electrical conductors to another one or more electrical conductors. For example, male to female electrical connections are commonly used to establish proper connections for compatible conductors, whether for power or data signal transmission. While connectors are frequently provided at the ends of respective flexible cords, in some applications such as work area environments it is desirable to rigidly or semi-rigidly mount connectors to another object or surface, such as an article of furniture or a wall or floor surface. However, rigidly or semi-rigidly mounted connectors present challenges such as proper alignment of one connector with another connector.

SUMMARY OF THE INVENTION

The present invention provides an electrical power coupling that utilizes magnetic connections and movable coupler parts to establish and maintain electrical contact between power transmitter that is mountable on a wall surface, furniture article, or the like, and a power receiver mountable that is mountable on another surface or article. Typically one or both of the transmitter and the receiver has a movable coupling portion mounted to a respective base, and may further include a magnetic or magnetically permeable material to help align and maintain a proper connection between the respective coupling portions. The power coupling permits power transfer, such as low voltage DC power transfer, via a magnet coupling that incorporates moveable components to facilitate and permit a proper electrical connection even when there are misalignments between the power transmitter and the power receiver.

According to one form of the invention, an electrical power coupling includes a pair of power coupling parts each having a base and a coupling portion, with first and second electrical contacts and a magnetic element at each coupling portion. The bases of the power coupling parts are configured for mounting to respective surfaces, and the coupling portions are each movable relative to the respective bases. The first electrical contacts are spaced laterally outboard a first distance from a center of each of the coupling portions, and the second electrical contacts are spaced a second distance laterally outboard from the center of each of the coupling portions, where the second distance is greater than the first distance. The magnetic elements are attracted to one another when the coupling portions are positioned in close proximity to one another so that the coupling portions will move relative to their respective bases, and so that the coupling portions substantially align with one another to establish electrical connections between the first electrical contacts and between the second electrical contacts upon positioning the coupling portions in close proximity.

In one aspect, a first of the power coupling parts is an electrical power transmitter and a second of the power coupling parts is an electrical power receiver. Optionally, the first electrical contact of the electrical power transmitter includes an outwardly-biased contact pin, and the first electrical contact of the electrical power receiver includes a circular conductive surface. Further optionally, the second electrical contact of the electrical power transmitter is in the form of an outwardly-biased contact pin, and the second electrical contact of the electrical power receiver is in the form of a circular conductive surface.

In another aspect, the first electrical contact of the electrical power transmitter includes a plurality of the outwardly-biased contact pins that are spaced circumferentially apart from one another and are equidistant from the center, while the second electrical contact of the electrical power transmitter includes a plurality of the outwardly-biased contact pins that are paced circumferentially apart from one another and are equidistant from the center.

In yet another aspect, the coupling portion of a first of the power coupling parts is pivotable about at least two pivot axes relative to the base of the first of the power coupling parts. Optionally, the coupling portion of the first of the power coupling parts is pivotably coupled to the base of the first of the power coupling parts via pivot pins.

In a further aspect, the coupling portion of a second of the power coupling parts is longitudinally extendable along a longitudinal axis extending through the center of the second of the power coupling parts. Optionally, the two pivot axes of the first power coupling part are orthogonal to one another, and the longitudinal axis of the second power coupling part is orthogonal to the two pivot axes of the first power coupling part.

In still another aspect, each of the power coupling parts further includes a biasing member that is configured to move or retain a respective one of the coupling portions to a retracted position relative to a respective one of the bases when the coupling portions are disengaged from one another. Optionally, the biasing member is at least one chosen from a magnet and a spring.

In a still further aspect, the magnetic element of a first of the coupling portions includes a permanent magnet, and the magnetic element of a second of the coupling portions includes at least one chose from a permanent magnet and a magnetically permeable material.

According to another form of the invention, an electrical power coupling includes a power transmitter, a power receiver, and at least four electrical contacts. The power transmitter has a transmitter base configured for mounting to a first surface, and further includes a power transmission portion coupled to the transmitter base. The power receiver has a receiver base that is configured for mounting to a second surface, and further includes a power receiver portion couple to the receiver base. The electrical contacts include at least two power transmission contacts at the power transmission portion, and at least two power receiver contacts at the power receiver portion. The power receiver contacts are configured to electrically engage respective ones of the at least two power transmission contacts. At least two of the electrical contacts are arcuate or circular in shape and have respective radii of curvature corresponding to a respective radial distance of each of the arcuate or circular electrical contacts to a center of a respective one of the power transmission portion or the power receiver portion. At least two others of the electrical contacts are (i) configured and positioned to engage respective ones of the arcuately shaped electrical contacts, and (ii) selectively positionable at different discrete locations that are spaced circumferentially apart along the respective ones of the arcuately shaped electrical contacts when the power receiver is rotated relative to the power transmitter.

Optionally, the arcuately shaped electrical contacts are fully circular in shape.

In one aspect, the power transmission portion is movable relative to the transmitter base and the power receiver portion is movable relative to the power receiver portion. Optionally, the power transmission portion is one of pivotably coupled to the power transmitter base, and the power receiver portion is translatably coupled to the power receiver base.

In another aspect, the electrical power coupling further includes a magnetic element in each of the power transmission portion and the power receiver portion, in which the magnetic elements are configured to attract one another to thereby facilitate establishing direct electrical connections between the power transmission contacts and respective ones of the power transmission contacts.

In a further aspect, at least two others of the electrical contacts include a first pair of outwardly-biased contact pins that are radially aligned with one another and a second pair of outwardly-biased contact pins that are radially-aligned with one another and spaced circumferentially apart from respective ones of the first pair of the outwardly-biased contact pins.

In still another aspect, a first of the at least two power transmission contacts is spaced laterally outboard by a first distance from a center of the power transmission portion, and a first of the at least two power receiver contacts is spaced laterally outboard by the first distance from a center of the power receiver portion. Optionally, a second of the at least two power transmission contacts is spaced laterally outboard by a second distance from the center of the power transmission portion, and a second of the at least two power receiver contacts is spaced laterally outboard by the second distance from the center of the power receiver portion, and in which the second distance is greater than the first distance.

In yet another aspect, a magnetic element is positioned at the center of each of the power transmission portion and the power receiver portion. The magnetic elements are configured to attract one another to thereby facilitate establishing direct electrical connections between the at least two power transmission contacts and respective ones of the at least two power transmission contacts.

Thus, the electrical power coupling of the present invention permits low voltage power transfer via a coupling that incorporates moveable components, and typically magnetic attraction, to facilitate a proper electrical connection even in the event of misalignments between the power transmitter and the power receiver. The device may be adapted for use in high voltage power arrangements and may also be adapted for wireless conductive charging or power transfer, for example.

These and other objects, advantages, purposes and features of the present invention will become apparent upon review of the following specification in conjunction with the drawings.

DESCRIPTION OF THE PREFERRED EMBODIMENTS

Figure 1:
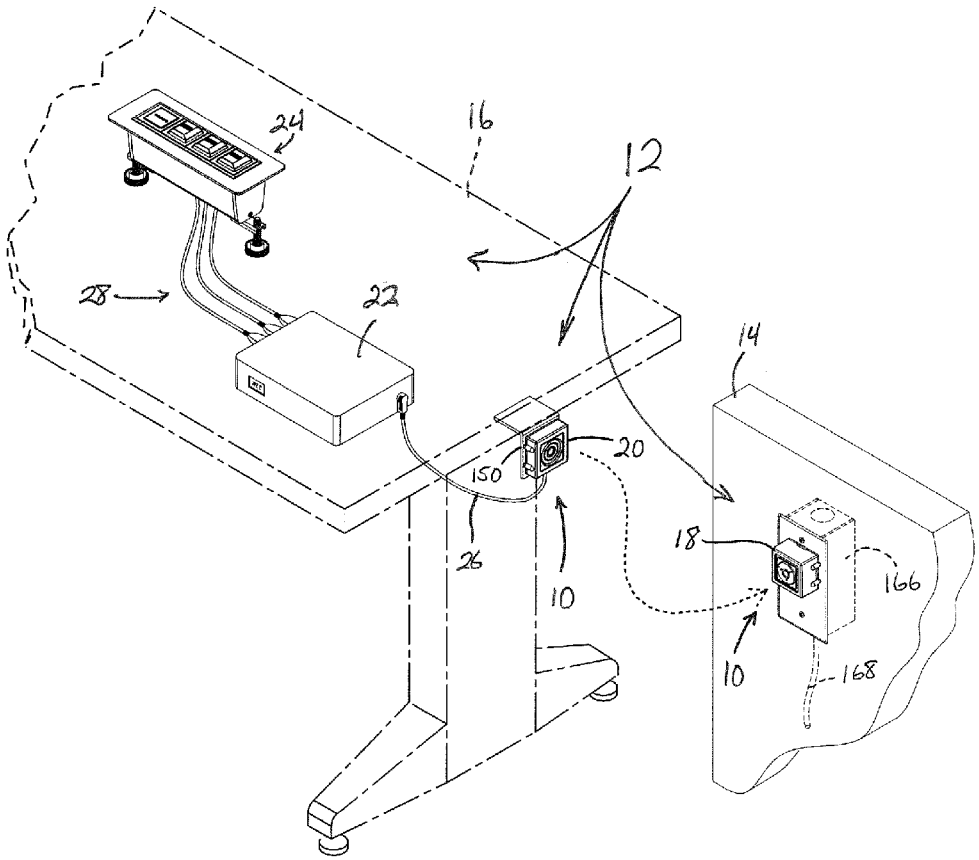
FIG. 1 is a perspective view of an electrical power system and coupling with magnetic connections in accordance with the present invention.

Referring now to the drawings and the illustrative embodiments depicted therein, an electrical power coupling 10 is incorporated into an electrical power system 12, which is mountable along various surfaces such as a wall surface 14 and a furniture article 16, such as shown in FIG. 1. Electrical power coupling 10 includes a power transmitter 18 and a power receiver 20, each having a respective power coupling part arranged so that the power coupling parts are configured to engage one another and thereby establish a direct electrical connection between power transmitter 18 and power receiver 20, even in the event that the power transmitter 18 and power receiver 20 are misaligned with one another and/or are at different rotational positions relative to one another.

Figure 2:
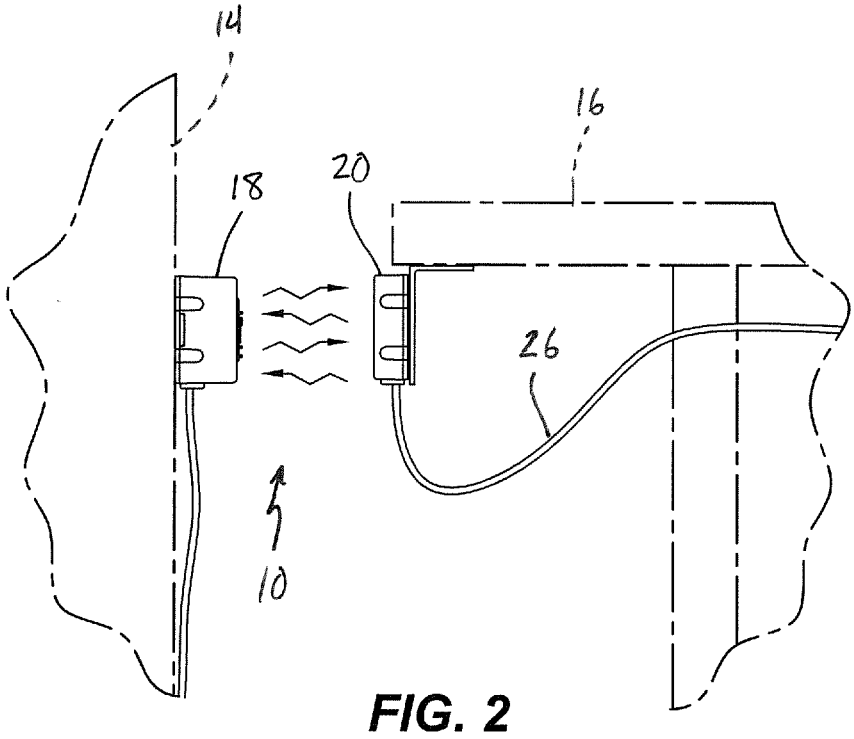
FIG. 2 is a side elevation of a power transmitter mounted along a wall surface and a power receiver mounted along a table, depicting initial magnetic interaction.
Figure 3:
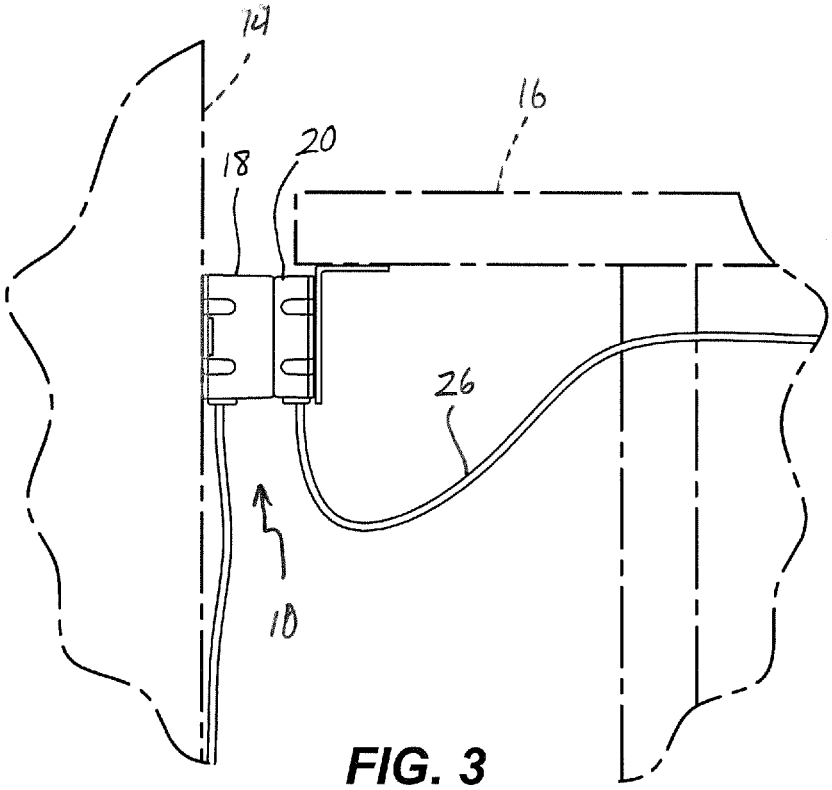
FIG. 3 is a side elevation of the power transmitter and power receiver of FIG. 2, shown in a coupled configuration.

In the illustrated embodiment of FIG. 1, electrical power system 12 further includes an electrical power storage unit such as a battery 22, and an electrical receptacle unit 24, which are both mounted to furniture article 16 such as a work table or the like. An electrical wire 26 couples power receiver 20 to battery 22, and additional electrical wires 28 coupled battery 22 to electrical receptacle unit 24. As will be described in more detail below, power transmitter 18 and power receiver 20 of electrical power coupling 10 include respective coupling portions that are configured to move into proper alignment and engagement with one another when furniture article 16 is positioned and aligned with power receiver 20 located sufficiently close to power transmitter 18, such as shown in FIGS. 2 and 3.

Figure 4:
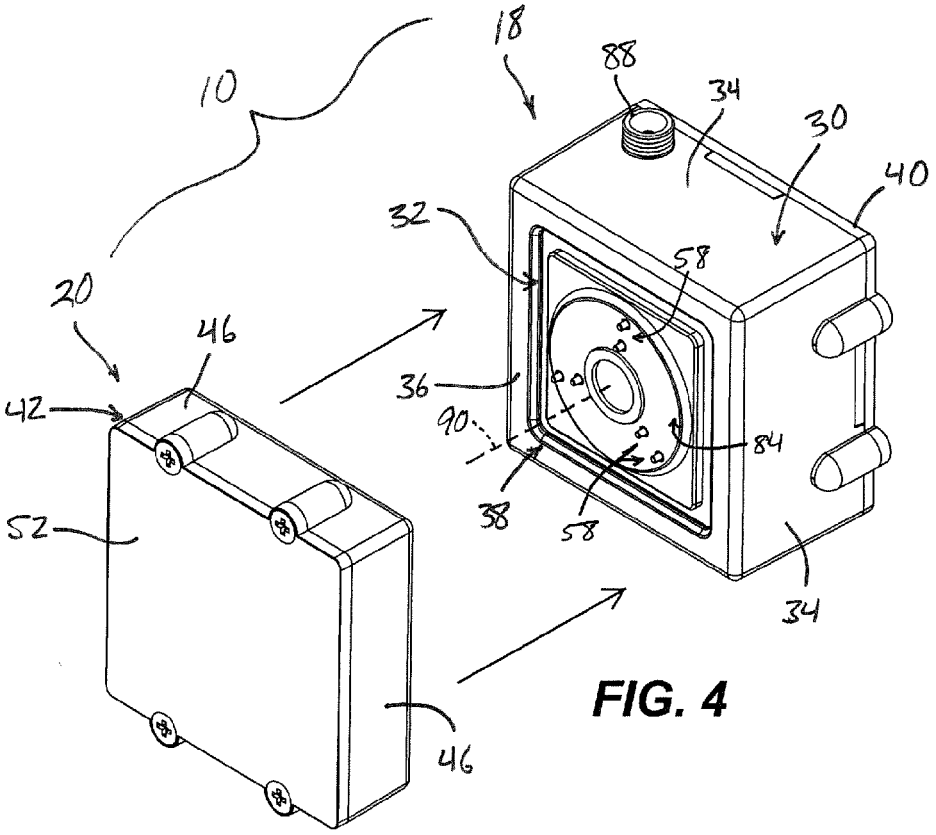
FIGS. 4-6 are perspective views of the power transmitter and power receiver in spaced arrangement prior to coupling.
Figure 5:
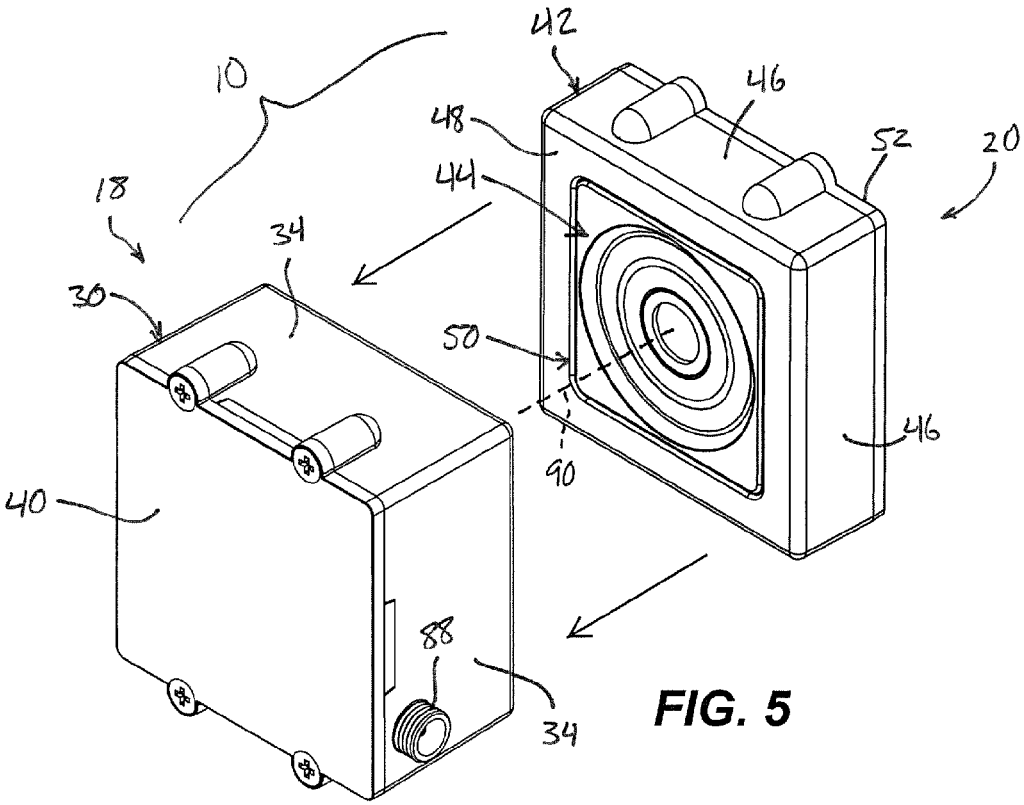
Figure 6:
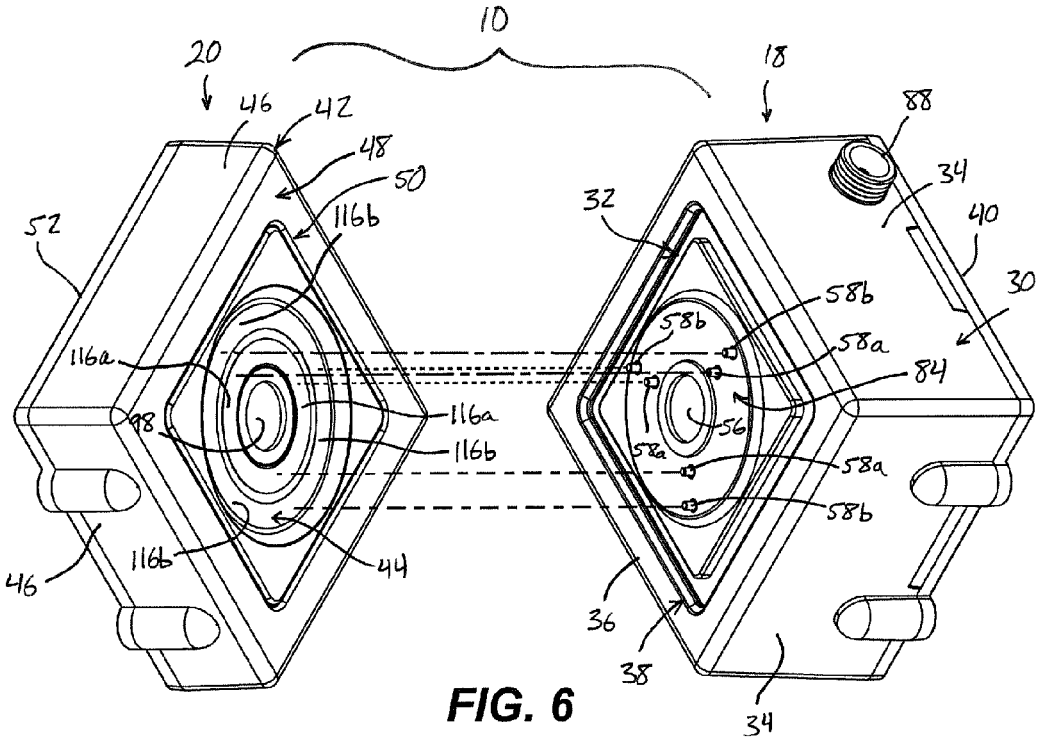

Electrical power transmitter 18 includes a transmitter base or housing 30 and a power transmission portion or coupling 32 that is movably coupled to transmitter base 30, such as shown in FIGS. 4-13B. Transmitter base 30 includes a plurality of sidewalls 34, a forward surface 36 defining an opening 38 through which transmission portion 32 is accessible, and a back panel 40 located opposite forward surface 36 and enclosing a rear portion of power transmitter 18 (FIGS. 4-6). Similarly, electrical power receiver 20 includes a receiver base or housing 42 and a power receiver portion or coupling 44 that is movably coupled to receiver base 42. Receiver base 42 includes a plurality of sidewalls 46, a forward surface 48 defining an opening 50 through which receiver portion 44 is accessible, and a back panel 52 located opposite forward surface 48 and enclosing a rear portion of power receiver 20.

Figure 9:
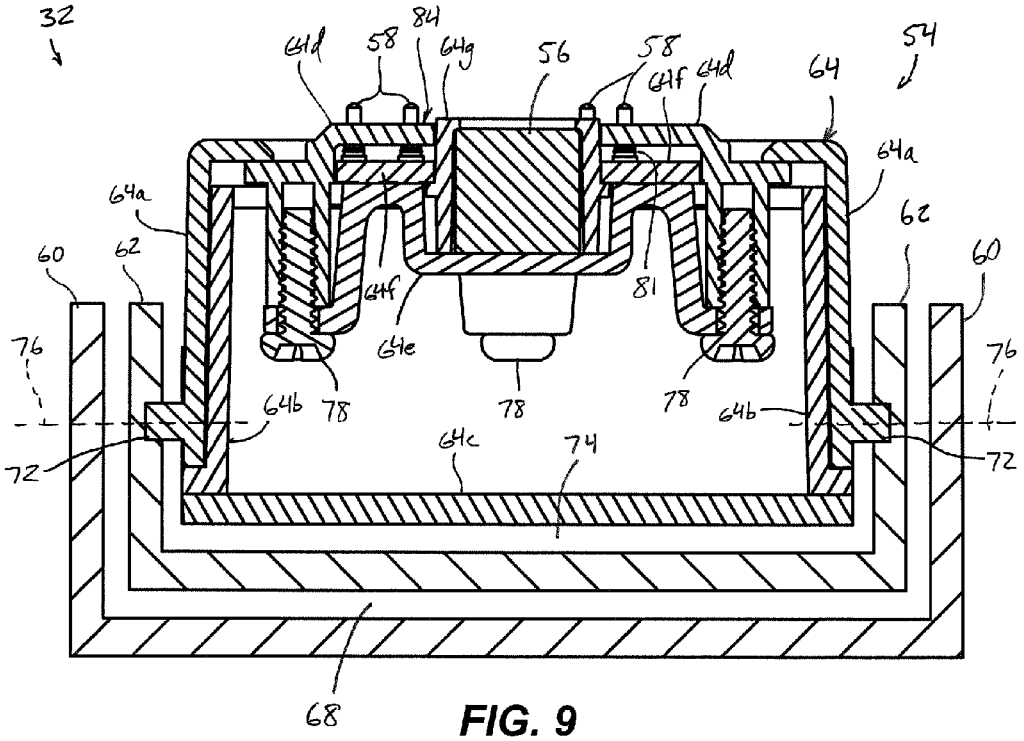
FIG. 9 is a side sectional elevation taken along line IX-IX in FIG. 8, with the transmitter base housing removed for clarity.
Figure 10:
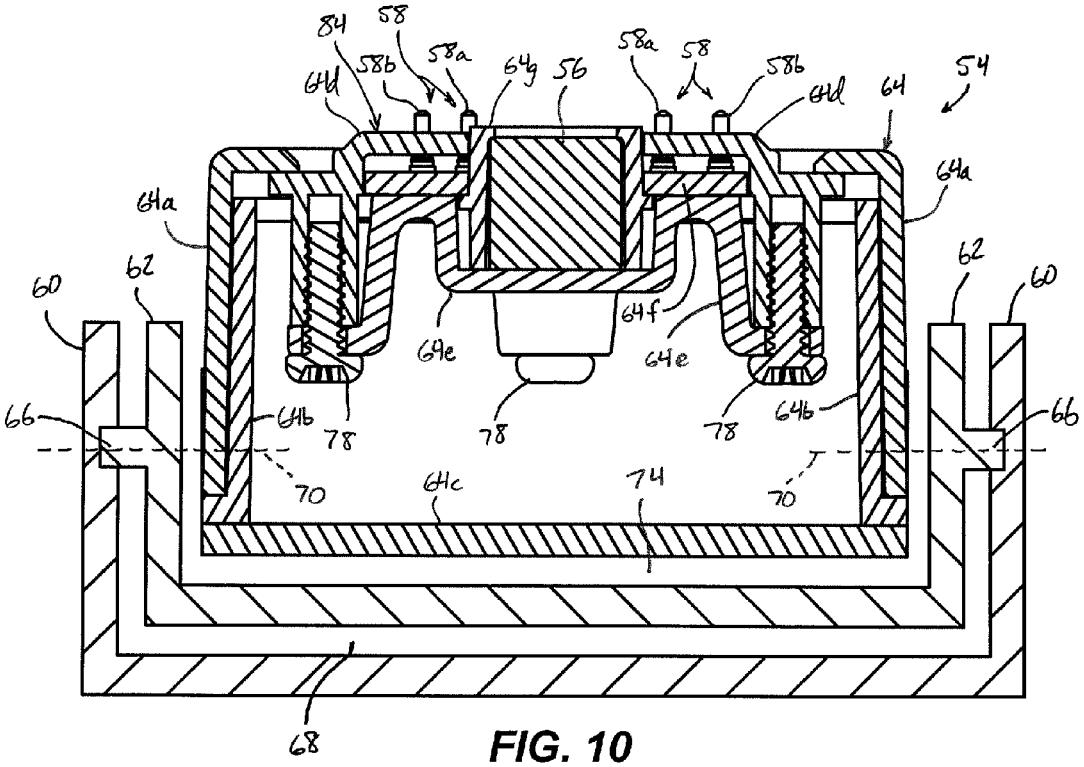
FIG. 10 is a side sectional elevation taken along line X-X in FIG. 8, with the transmitter base housing removed for clarity.
Figure 11:
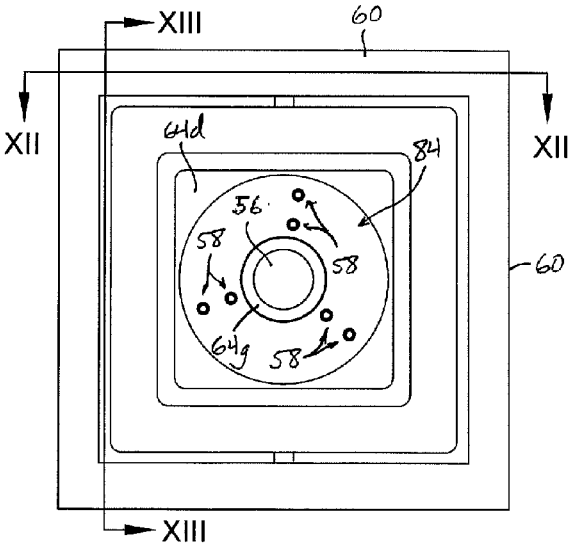
FIG. 11 is another front elevation of the power transmitter.
Figure 21:
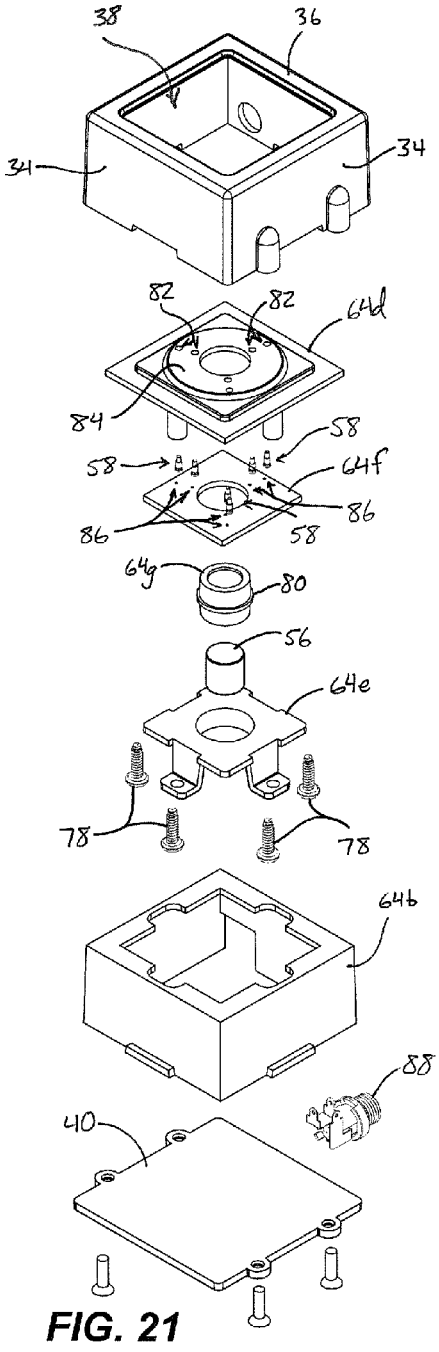
FIG. 21 is an exploded perspective view of the power transmitter, in which certain housing portions are omitted.

Power transmission portion or coupling 32 is assembled from a multi-piece power transmission housing 54 containing a permanent magnet 56 at its center, and a plurality of electrical contacts in the form of outwardly or forwardly-biased pins 58, as shown in FIGS. 6-10, 19A, 19B, and 21, and in particular FIGS. 9 and 10. Power transmission housing 54 includes an outer housing piece 60, an intermediate housing piece 62, and an inner housing assembly 64 that supports magnet 56 and contact pins 58. Inner housing assembly 64 includes an outer perimeter piece 64*a*, an inner perimeter piece 64*b*, a backing piece 64*c*, a central and forward housing piece 64*d*, a magnet-backing piece 64*e*, a pin-backing piece 64*f*, and a central magnet holder 64*g*, such as shown in FIGS. 9, 10, and 21.

Figure 7:
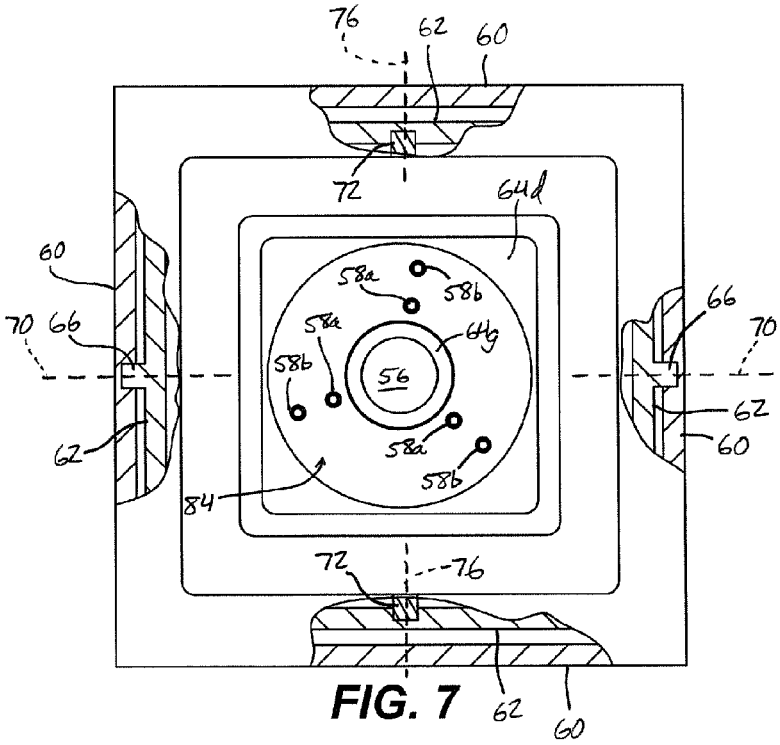
FIG. 7 is a front elevation of inner portions of the power transmitter with side portions partially cut away to show internal structure.
Figure 8:
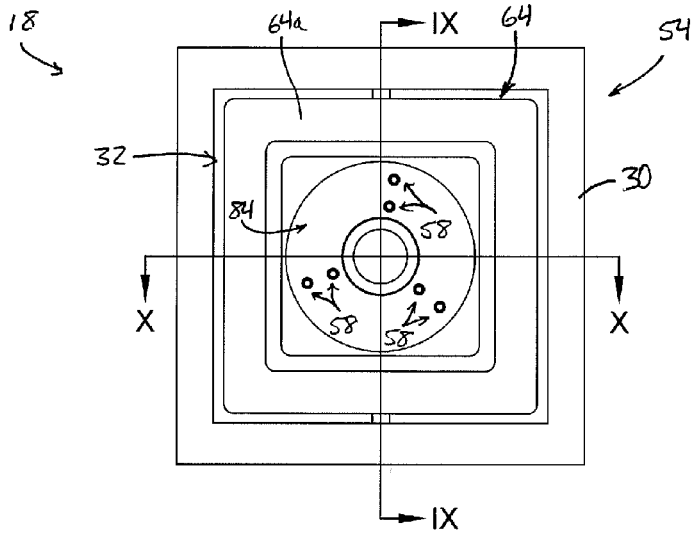
FIG. 8 is another front elevation of another power transmitter of FIG. 7.
Figure 12A:
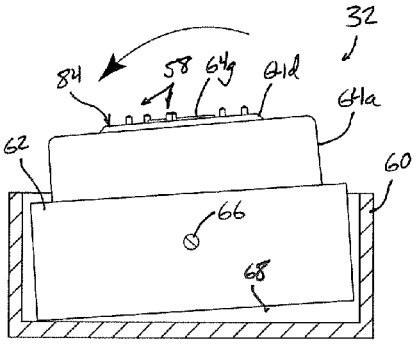
FIGS. 12A and 12B are side sectional elevations taken along line XII-XII of FIG. 11 and depicting different pivoted positions of the power transmitter coupling portion relative to its base.
Figure 12B:
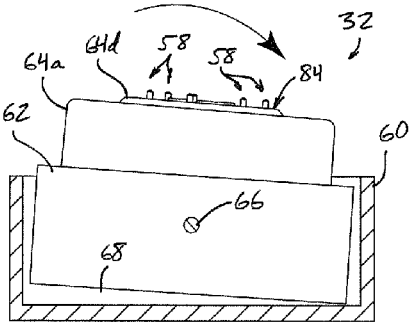
Figure 13A:
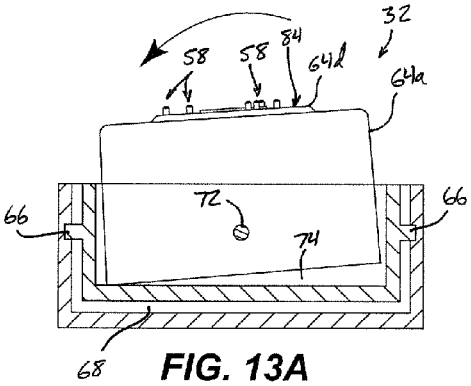
FIGS. 13A and 13B are side sectional elevations taken along line XIII-XIII of FIG. 11 and depicting different pivoted positions of the power transmitter coupling portion relative to its base.
Figure 13B:
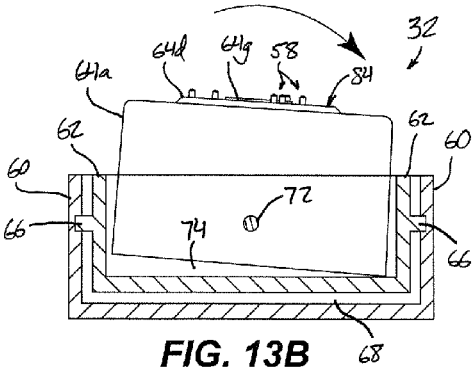

Outer housing piece 60 is sized and shaped to be received within a cavity or inner chamber defined by transmitter base 30, such that outer housing piece 60 remains substantially fixed relative to transmitter base 30. Intermediate housing piece 62 includes a pair of outwardly-extending pivot pins 66 that engage respective bores defined along interior surfaces of opposite sidewalls of the outer housing piece 60, such as shown in FIGS. 7 and 10. A space 68 is defined between respective rear panels of intermediate housing piece 62 and outer housing piece 60, and permits intermediate housing piece 62 to pivot by a limited amount or degree about a first pivot axis 70, such as shown in FIGS. 10, 12A, and 12B. Similarly, power transmission housing 54 (specifically, outer perimeter piece 64*a*) includes a pair of outwardly-extending pivot pins 72 on opposite sides thereof, for engaging respective bores defined along interior surfaces of opposite sidewalls of the intermediate housing piece 62, such as shown in FIGS. 7 and 9. A space 74 is defined between backing piece 64*c* and a rear panel of intermediate housing piece 62, which permits power transmission housing 54 to pivot by a limited amount or degree about a second pivot axis 76, such as shown in FIGS. 9, 13A, and 13B. Thus, pivot pins 66, 72 permit power transmission housing 54 to pivot about two different axes 70, 76 relative to outer housing piece 60 and power transmitter base 30 in a gimballing or gimbal-like manner, where pivot axes 70, 76 are substantially perpendicular or orthogonal to one another and lie in respective lateral planes.

Figure 17:
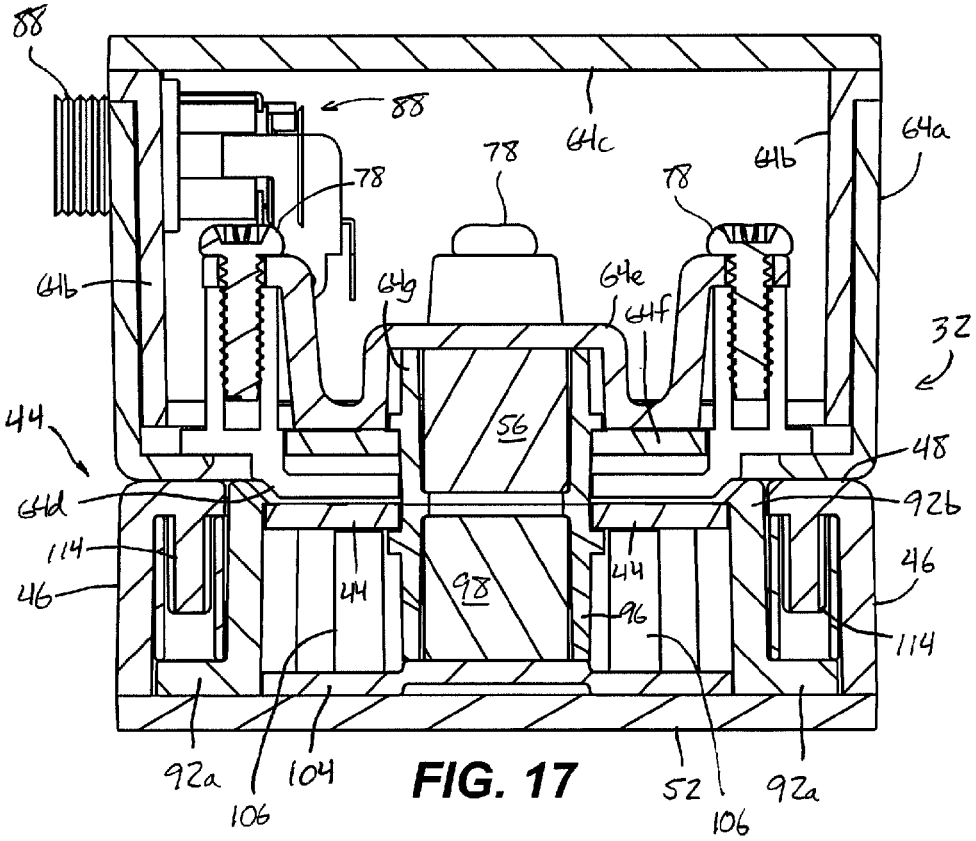
FIG. 17 is a side sectional elevation of the coupled power receiver and power transmitter taken along line XVII-XVII of FIG. 16.
Figure 18:
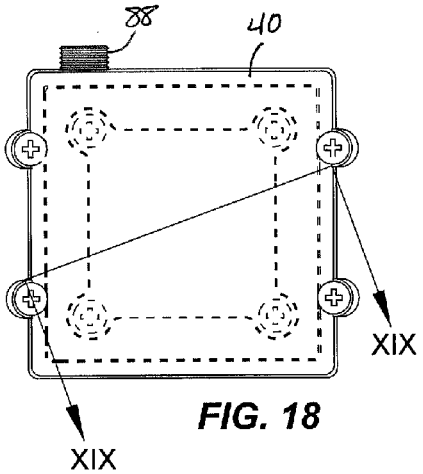
FIG. 18 is another elevation view of a power receiver and power transmitter.

Magnet-backing piece 64*e* is secured to central and forward housing piece 64*d* by a plurality of threaded fasteners 78, such as shown in FIGS. 9, 10, and 17. A space or cavity is defined between magnet-backing piece 64*e* and the central and forward housing piece 64*d*, and is sized and shaped to secure pin-backing piece 64*f* and central magnet holder 64*g*, where the pin-backing piece 64*f* engages a radial flange 80 of central magnet holder 64*g* to secure the central magnet holder 64*g* and magnet 56 relative to central and forward housing piece 64*d* and magnet-backing piece 64*e*. A plurality of biasing members in the form of coil springs 81 are held in compression between the central and forward housing piece 64*d* and the pin-backing piece 64*f*, and are disposed in or behind respective contact pins 58 (FIG. 19A) so that the springs bias the pins 58 forwardly and out through respective openings 82 defined in an annular forward surface 84 of the central and forward housing piece 64*d*, such as shown in FIG. 21. Pin-backing piece 64*f* defines respective bores 86 with which contact pins 58 are aligned, so that individual conductors (not shown) that are associated with the contact pins 58 may pass through pin-backing piece 64*f* to establish electrical connections with respective terminals of an electrical coupling piece 88 that is mounted in one of the sidewalls 34 of transmitter base 30, such as shown in FIGS. 4, 6, and 21. Referring to FIG. 21, it is readily seen that each of central and forward housing piece 64*d*, magnet-backing piece 64*e*, pin-backing piece 64*f*, and magnet holder 64*g* defines a respective bore or opening for receiving magnet 56 and/or magnet holder 64*g*.

Contact pins 58 are arranged in two sets of three, including an innermost set of three pins 58*a* having a first polarity or electrical potential, and an outermost set of three pins 58*b* having a second or opposite polarity or electrical potential. The innermost pins 58*a* are set a first radial distance (i.e., are equidistant) from a center or central axis 90 that passes through the middle of annular forward surface 84 and magnet 56, and are circumferentially evenly spaced apart from one another, with 120 degrees of separation between each of the three innermost pins 58*a*. Similarly, the outermost pins 58 are set a second radial distance (i.e., are equidistant) from the center or central axis 90 and are evenly spaced circumferentially apart from one another, with 180 degrees of separation between each of the three outermost pins 58*b*. In the illustrated embodiment, each of the outermost pins 58*b* is radially aligned with a respective one of the innermost pins 58*a*, and the second radial distance of outermost pins 58*b* is sufficiently greater than the first radial distance of innermost pins 58*a* so as to preclude contact and resultant short circuiting between the innermost pins 58*a* and adjacent ones of the outermost pins 58*b*. It will be appreciated that the circumferential spacing of the pins 58, as well as the radial spacing, the number of pins, and the pins' tip shapes and sizes, can be varied as desired, such as to accommodate different electrical current loads, without departing from the spirit and scope of the present invention.

Figure 15A:
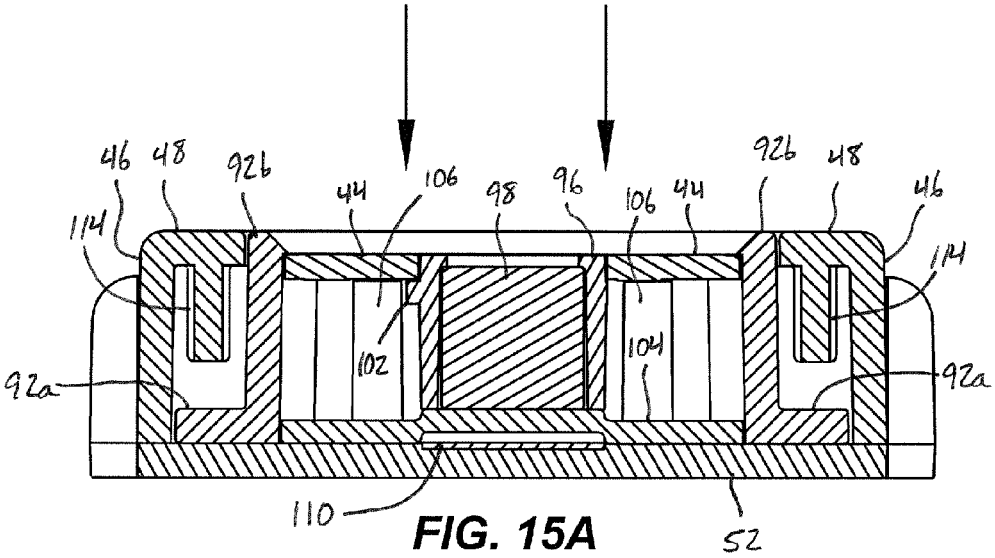
FIGS. 15A and 15B are side sectional elevations taken along line XV-XV of FIG. 14 and depicting retracted and extended positions of the power receiver's coupling portion relative to its base.
Figure 15B:
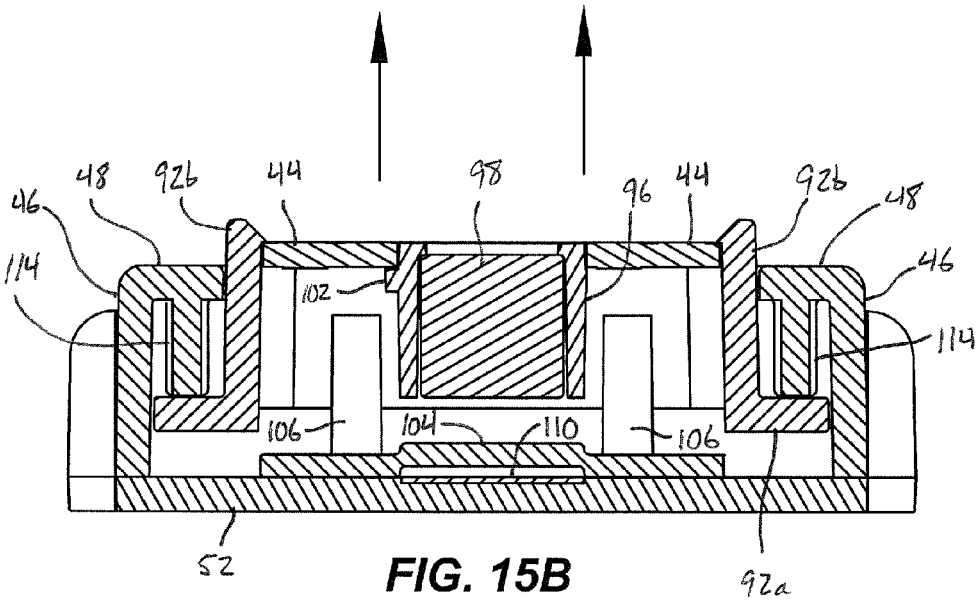
Figure 16:
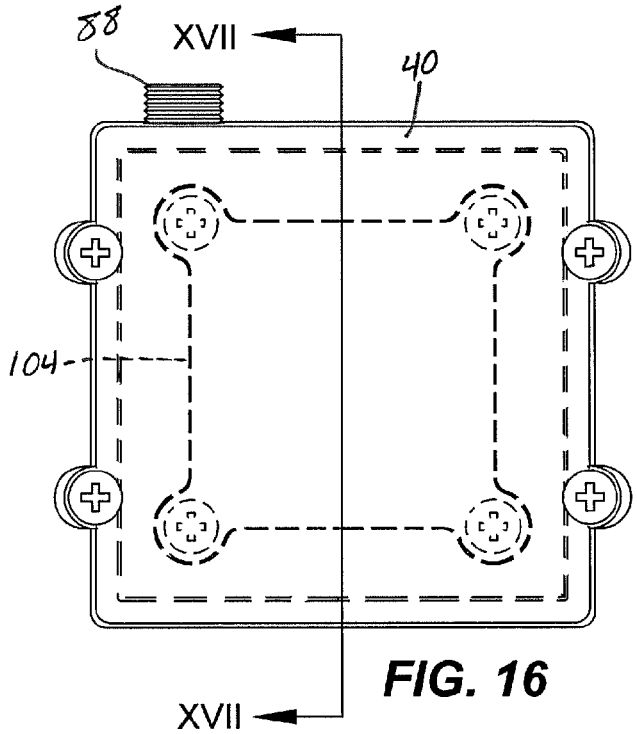
FIG. 16 is an elevation view of a power receiver and power transmitter shown coupled together.
Figure 20:
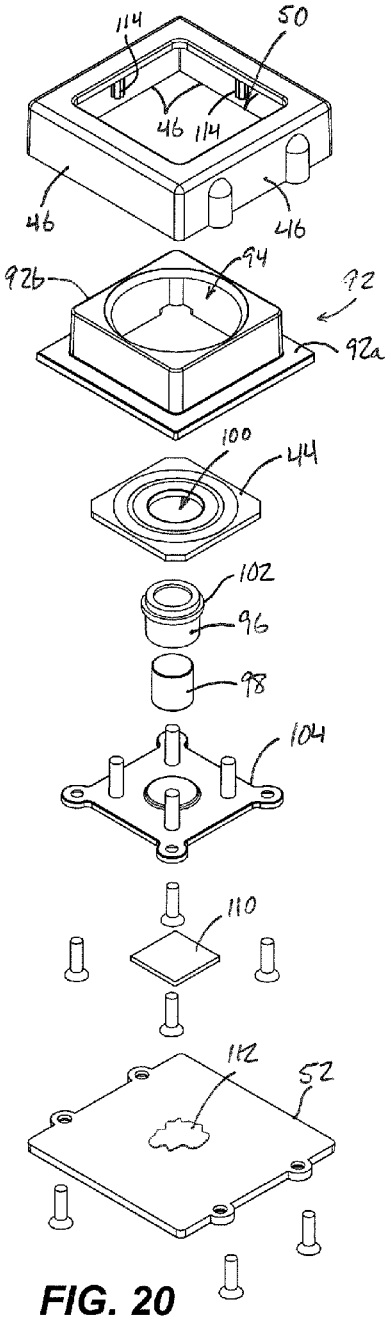
FIG. 20 is an exploded perspective view of the power receiver, in which pivoting housing portions are omitted.

Power receiver 20 is assembled from various components including the aforementioned receiver base or housing 42 and power receiver portion or coupling 44. In addition, a movable interior housing piece 92 includes a base flange 92*a* and a forward-projecting portion 92*b* that defines a circular opening 94 through which power receiver portion 44 is accessible, such as shown in FIGS. 15A, 15B, and 20. Power receiver portion 44 is received in a forward and of forward-projecting portion 92*b* of interior housing piece 92, with a magnet holder 96 containing a permanent magnet 98 supported in a circular opening 100 formed in a central region of power receiver portion 44. Magnet holder 96 includes an outer perimeter flange 102 that is only slightly larger than an inner diameter of opening 100, so that magnet holder 96 and magnet 98 are retained by power receiver portion 44. It will be appreciated that the magnets 98, 56 may be identical or substantially identical to one another, and are arranged in their respective holders so that their opposite poles are directed toward one another for attraction. Optionally, one of the magnets may be substituted or replaced with substantially any sufficiently magnetically permeable material, such as a ferrous metal, provided that a sufficient attractive force can be generated between the power transmission portion and the power receiver portion to draw these components toward one another. It will further be appreciated that the magnets or magnetically permeable materials can be positioned at different locations along or in the moveable coupling portions, and are not required to be centrally located to each coupling portion.

Figure 22:
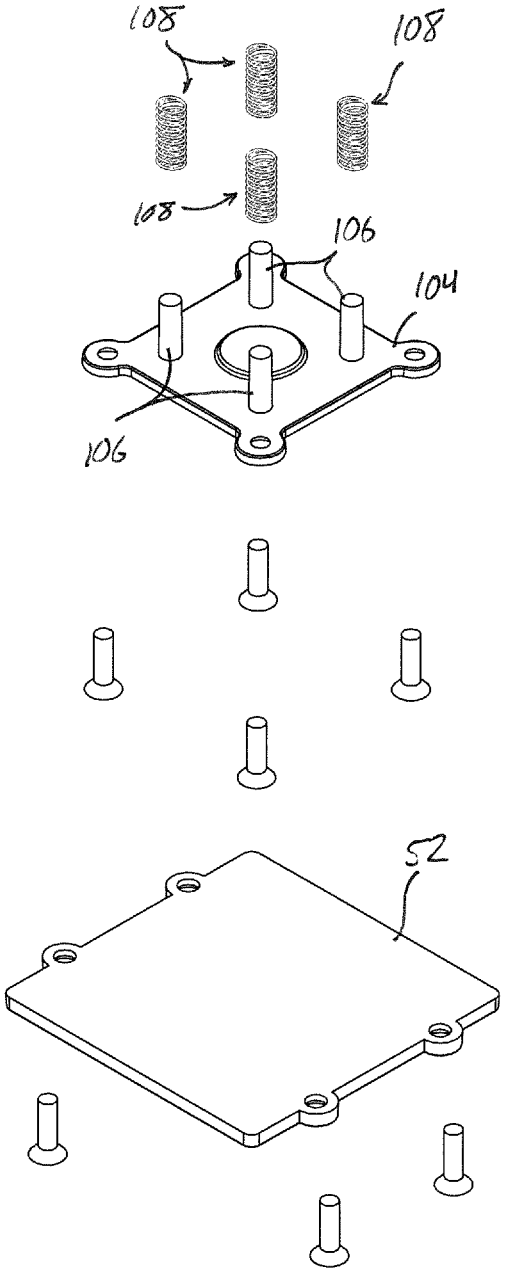
FIG. 22 is an enlarged exploded perspective view of a rear portion of the power receiver.

A backing plate 104 is positioned behind power receiver portion 44, magnet holder 96, and magnet 98, and may be fixed to back panel 52 of receiver base 42 such as shown in FIGS. 15A and 15B. Optionally, backing plate 104 can be "free-floating" with movable interior housing piece 92 and power receiver portion 44, relative to receiver base 42. In a free-floating arrangement, when power receiver 20 is not engaged with power transmitter 18, movable interior housing piece 92, power receiver portion 44, magnet 56, and backing plate 104 may be biased rearwardly (i.e., toward back panel 52) by a magnet 110 that is attached or secured to back panel 52 by an adhesive substance 112 or the like (FIG. 20). Backing plate 104 has four posts 106 on which, optionally, respective coil springs 108 (FIG. 22) can be mounted and held in tension between backing plate 104 and a rear surface of power receiver portion 44, to retract receiver portion 44 when it is not drawn outwardly or forwardly by magnet 98.

In the illustrated embodiment, magnet 98 is capable of drawing itself, magnet holder 96, and power receiver portion 44 rearwardly or inwardly toward backing plate 104 when magnet 98 is not drawn toward magnet 56 of power transmitter 18 (FIGS. 15A and 15B). The rearward or inward movement of these components is limited by contact of magnet holder 96 with backing plate 104, by contact of forward ends of posts 106 with a rearward surface of power receiver portion 44, and by contact of base flange 92*a* of movable interior housing piece 92 with a forward surface of back panel 52, such as shown in FIG. 15A. The forward or outward movement of magnet 98, magnet holder 96, and power receiver portion 44 is limited by contact of a forward surface of the base flange 92*a* with rear surfaces of respective rearwardly-projecting posts 114 that extend rearwardly from the forward surface 48 of receiver base 42, such as shown in FIGS. 15B and 20.

Figure 14:
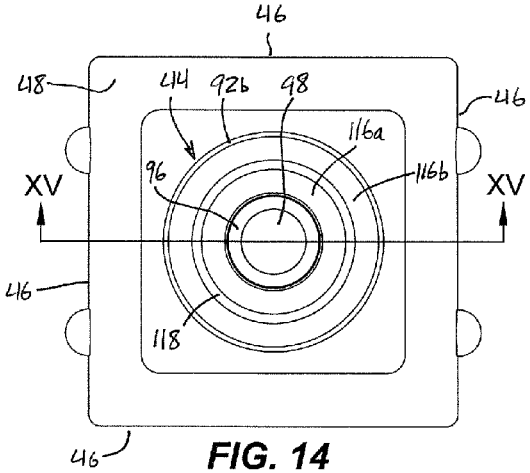
FIG. 14 is a front elevation of the power transmitter.
Figure 19A:
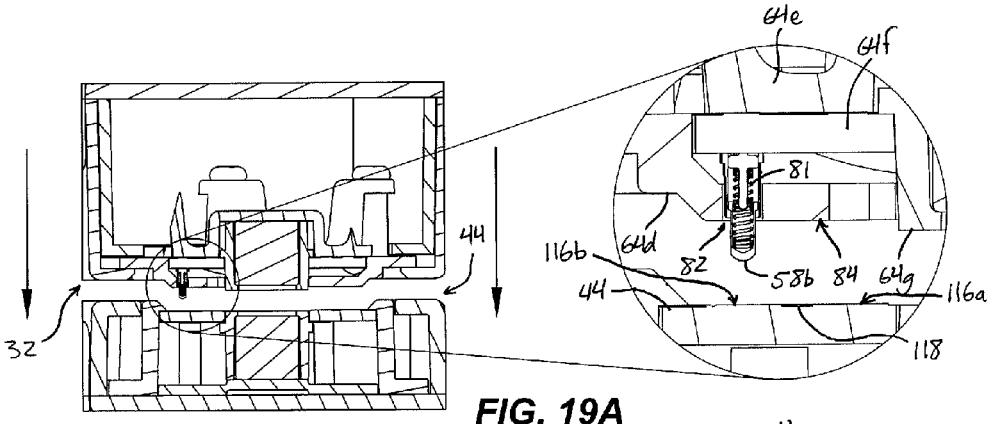
FIG. 19A is a side sectional elevation of the power receiver and power transmitter taken along line XIX of FIG. 18, shown just prior to coupling and including an enlarged view of an electrical coupling region.
Figure 19B:
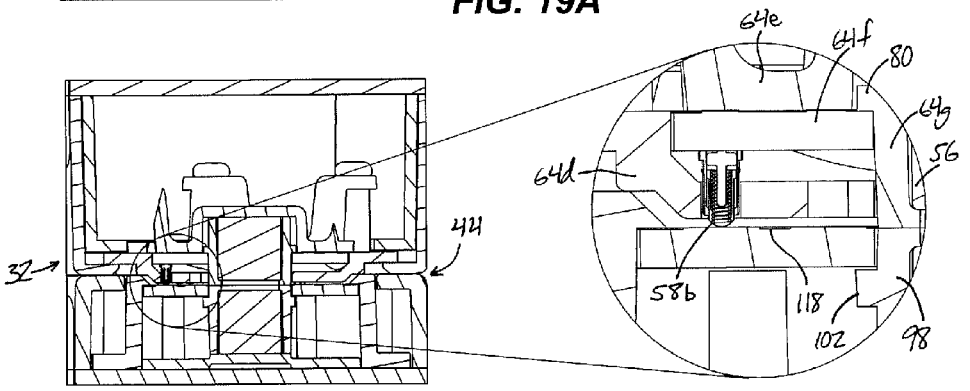
FIG. 19B is another side sectional elevation of the power receiver and power transmitter taken along line XIX of FIG. 18, shown in the coupled configuration and including an enlarged view of an electrical coupling region.

As best shown in FIGS. 5, 6, and 14, power receiver portion or coupling 44 includes two arcuate electrical contacts in the form of a circular inner contact 116*a* and a circular outer contact 116*b* that are separated or electrically isolated by a circular insulative surface or body 118, which is also shown in FIGS. 19A and 19B. Inner contact 116*a* has inner and outer edges with corresponding radii that are equal to their respective distances from the center or central axis 90 of power receiver 20, which passes through magnet 98 (FIG. 5). Likewise, outer contact 116*b* has inner and outer edges with corresponding radii that are equal to their respective distance from the center or central axis 90 of power receiver 20. It will be appreciated that the mean radius of inner contact 116*a* (i.e., the distance from axis 90 to the middle of inner contact 116*a*, between its inner and outer edges) is approximately equal to the first radial distance of innermost pins 58*a* to central axis 90, and that the mean radius of outer contact 116*b* (i.e., the distance from axis 90 to the middle of outer contact 116*b*, between its inner and outer edges) is approximately equal to the second radial distance of outermost pins 58*b* to central axis 90. The arcuate or circular shapes of inner contact 116*a* and outer contact 116*b* permits the respective contact pins 58*a*, 58*b* to establish electrical connections regardless of the rotational orientation of power receiver 20 relative to power transmitter 18. For example, with reference to FIGS. 4-6, it will be observed that power transmitter 18 has been rotated approximately 90 degrees about central axis 90 as shown in FIGS. 5 and 6 as compared to FIG. 4.

However, it will be appreciated that the contacts of power receiver 20 can be other shapes, without departing from the spirit and scope of the present invention. For example, arcuate shapes having a radius of curvature generally corresponding to the respective contact's distance to the central axis would provide similar functionality, although the permissible range of rotation of the power receiver relative to the power transmitter would be more limited in such an arrangement. It is further envisioned that larger contact patches or larger-width inner and outer circular (or arcuate) contacts would provide additional tolerance for variations in the positioning of the contact pins, including some tolerance for lateral misalignment of the power receiver portion 44 with the power transmission portion 32. In addition, each of the power transmitter and power receiver can utilize a combination of one or more contact pins and one or more arcuate or circular contacts to establish appropriate electrical connections between the other of the power transmitter and power receiver.

Accordingly, power transmitter 18 and power receiver 20 are capable of establishing an electrical connection that is sufficient to transmit at least low voltage DC electrical power across power coupling 10. This capability is facilitated by several factors including the power receiver portion or coupling 44 being configured to project outwardly or forwardly from receiver base 42 along axis 90 in response to the proximity of the power transmitter's magnet 56 to the power receiver's magnet 98, as well as the ability of power transmitter portion 32 to pivot about two different axes 70, 76 in response to the proximity of the power receiver's magnet 98 to the power transmitter's magnet 56. The ability to establish an appropriate electrical connection is further enhanced by the use of two or more contact pins 58 of each polarity and spaced circumferentially and radially apart from one another, as well as the use of arcuate or circular inner and outer contacts 116*a*, 116*b* of the power receiver portion or coupling 44 that allow for both lateral offset and rotational variances or changes between power transmitter 18 and power receiver 20.

Referring to FIGS. 17 and 19B, power transmitter portion 32 and power receiver portion 44 are shown coupled together in a substantially perfect alignment, which is achievable even when the respective transmitter base 30 and receiver base 42 (not shown in FIGS. 17 and 19B) are misaligned with one another. It will be appreciated that this alignment is achievable due to the gimbaling capability of power transmitter portion 32 in transmitter base 30 (FIGS. 12A-13B) and the longitudinal extendibility of power receiver portion 44 relative to receiver base 42 (FIGS. 15A and 15B). In FIG. 19A, power transmitter portion 32 is being brought into close proximity to the power receiver portion 44, so that magnetic interaction causes the power receiver portion 44 to be drawn outwardly toward the transmitter portion 32. Once the components are coupled together, the contact pins 58 of the electrical transmitter will partially retract as their springs 81 are compressed by the higher attractive force of magnets 56, 98, while springs 81 help to ensure and maintain a proper electrical connection between the contact pins 58*a*, 58*b* and the respective circular contacts 116*a*, 116*b* of power receiver portion 44 when the components are mated together as shown in FIG. 19B.

Power transmitter 18 and power receiver 20 are simply pulled apart to overcome the attractive force between magnets 56, 98, when the electrical connection of electrical power coupling 10 is no longer needed or desired. As discussed above, upon separation of power transmitter 18 and power receiver 20 and their corresponding magnets 56, 98, power receiver portion 44 retracts into power receiver base 42 due to spring or magnetic force. Although not shown in the illustrated embodiments, it is envisioned that light springs or other biasing members may be incorporated (such as in spaces 68, 74) to provide a centering function of power transmitter portion 32 relative to transmitter base 30.

It will be appreciated that there are many different variations ordered design alterations that may be implemented without departing from the spirit and scope of the present invention. For example, power transmitter 18 could be readily converted to act as a power receiver, while power receiver 20 could be readily converted to act as a power transmitter, without any mechanical or electrical changes to either device. In such an arrangement, the concentric circular contacts 116*a*, 116*b* would be electrically energized at different electrical potentials or polarities, and contact pins 58 would not be energized until making contact with respective ones of the circular contacts 116*a*, 116*b*. In addition, although it is generally considered unnecessary to block or inhibit access to electrical contacts in low-voltage applications such as those primarily described herein, it is envisioned that either the contact pins or the concentric circular contacts (whichever is energized as the power transmitter) could be recessed in order to inhibit or prevent inadvertent contact by persons or conductive materials. In such an arrangement, it is envisioned that the electrical power coupling may be made suitable for high voltage AC power couplings. Therefore, although primarily shown and described herein as being for a low voltage power connection, such as a 5-volt or 12-volt DC connection, it will be appreciated that the principles of the present invention may be readily adapted for high voltage AC connections with appropriate modifications for safety in handling high voltage power transmission.

Figure 23:
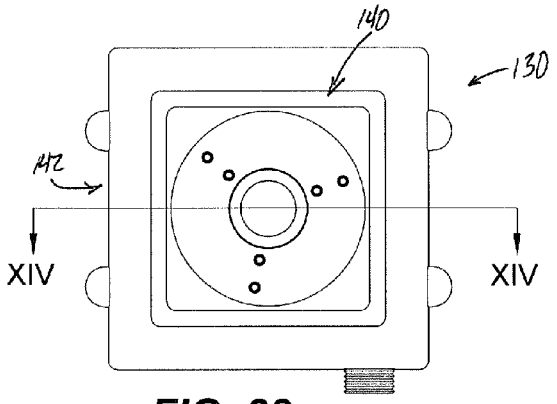
FIG. 23 is a front elevation of another power transmitter in accordance with the present invention.
Figure 24:
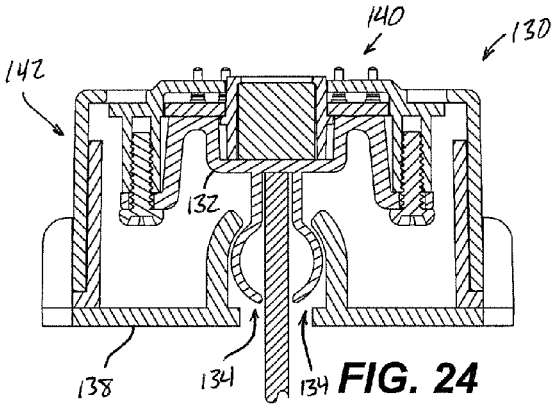
FIG. 24 is a side sectional elevation of the power transmitter taken along line XIV-XIV of FIG. 23.
Figure 24A:
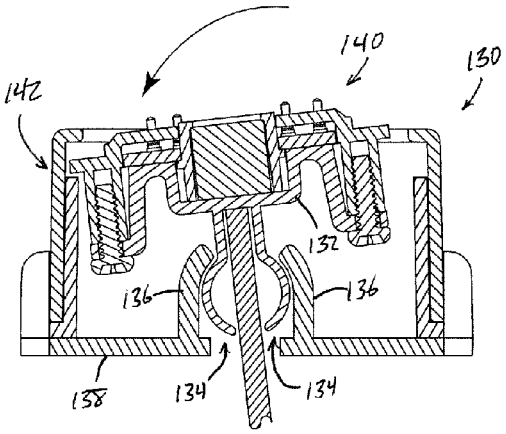
FIGS. 24A and 24B are additional side sectional elevations of the power transmitter of FIG. 23, depicting different pivoted positions of the power transmitter coupling portion relative to the power transmitter base.
Figure 24B:
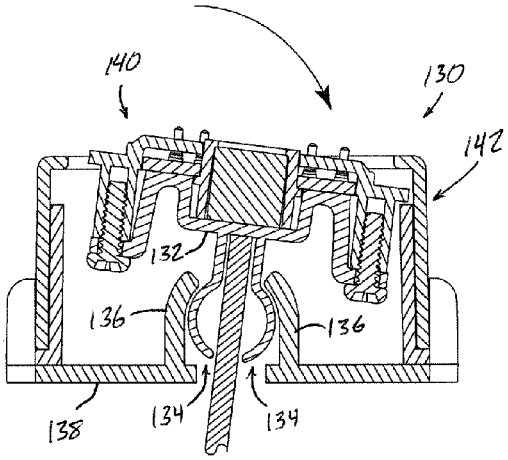

Other mechanical variations may include, for example, a ball-and-socket arrangement in which an alternative power transmitter 130 includes fewer housing parts and fewer moving parts, such as shown in FIGS. 23-24B. Instead of using pins aligned in different axes as in power transmitter 18, the alternative power transmitter 130 utilizes a magnetic backing piece 132 having a generally spherical projection 134 extending rearwardly from a middle region. It will be appreciated that the generally spherical projection may be formed of multiple projections that are similar in shape and arranged in a circle. Generally spherical projection 134 is received in a socket arrangement 136 formed from one or more extensions projecting forwardly from a central region of a back panel 138. The dimensions of spherical projection 134 and of socket arrangement 136 may be such that a movable power transmission portion 140 (which includes magnetic backing piece 132 and spherical projection 134) is supported exclusively by socket arrangement 136 while permitting pivoting movements in substantially any lateral axis, such as shown in FIGS. 24A and 24B. In addition, the length dimension of socket arrangement 136 may be sufficient to permit at least a limited amount of forward and rearward axial movement of movable power transmission portion 140 relative to a transmitter base 142 (which includes back panel 138), in addition to the pivoting motions illustrated in FIGS. 24A and 24B.

Although the power transmitter with a power transmission portion capable of pivoting in at least two axes, in combination with the power receiver having a power receiver portion capable of axial translation, have been found to facilitate desirable mating contact of the respective surfaces, it will be appreciated that either or both of the power transmitter and power receiver could be designed with substantially any combination of translation and/or pivoting capability, in order to accommodate different positional variations between the power transmitter and receiver. Accordingly, it will be appreciated that the electrical power coupling of the present invention is not necessarily limited to a power transmitter having pivoting capability in two or more axes, in combination with a power receiver having axial extension and retraction capabilities, since the various movement capabilities could be built into either or both portions of the electrical power coupling, and because other design features (including the arrangement and shapes of the electrical contacts) also accommodate positional variations and facilitate establishing sufficient electrical connections for at least low voltage DC power transmission.

Different applications for the electrical power coupling are envisioned, such as the table-mounted arrangement of FIG. 1, in which power receiver 20 is mounted to an underside of a table top using an L-shaped bracket 150, and is capable of recharging battery 22 when aligned with and contacting the wall-amounted power transmitter 18, such as indicated with a curved-line arrow in FIG. 1. In such an arrangement, the individual receptacles of electrical receptacle unit 24 can be energized whenever power is applied to power receiver 20 via power transmitter 18 and/or when battery 22 contains a sufficient charge of electrical power even when power receiver 20 is disconnected from power transmitter 18.

Figure 25:
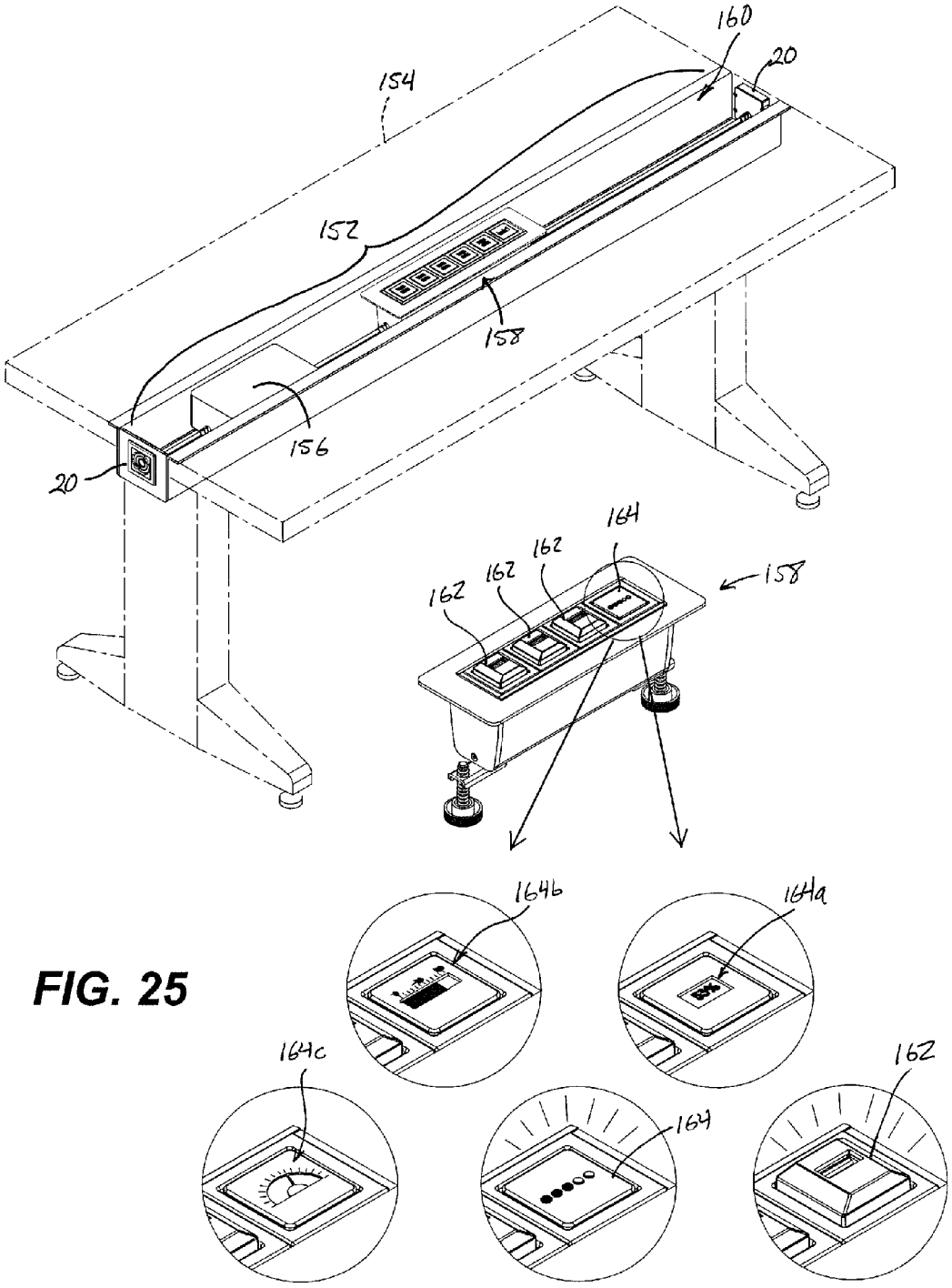
FIG. 25 is a perspective view of a table incorporating an electrical system with power transmitter and power receiver, onboard power supply, and low voltage outlets, including enlarged views of an alternative low voltage power unit and of various different power level indicators.

Other arrangements may include, for example, an electrical power system 152 including one power receiver 20 positioned at each opposite and of a table 154, with a battery or electrical storage device 156 and an electrical receptacle unit 158 positioned along the table 154, such as in a central longitudinal channel 160 below an upper surface of table 154, such as shown in FIG. 25. This arrangement permits electrical receptacle unit 158 and/or battery 156 to be supplied with electrical power from either power receiver 20, which reduces the likelihood that table 154 will need to be moved a significant distance in a room, or rotated, in order to establish a connection between one of the power receivers 20 and a power transmitter (not shown in FIG. 25). Optionally, a power transmitter could be substituted for one of the power receivers, in order to permit a daisy-chain arrangement in which one table-mounted electrical power system can be powered by another arranged in series.

In the illustrated embodiment of FIG. 25, electrical receptacle unit 158 includes three low-voltage DC receptacles 162 (USB-style receptacles are shown) plus a power level indicator 164 that provides users with a visual indicator of the power level remaining in the associated battery 156, which may be hidden from view by table 154 or other furniture article or the like. In the illustrated embodiment, the power level indicator 164 includes five lights that selectively illuminate to indicate level of charge. However, other power level indicators may include a numerical display 164*a*, a bar-graph display 164*b*, or a needle-type power meter display 164*c*, all of which are shown in alternative views in FIG. 25. In addition, another low-voltage DC receptacle 162 may be substituted for power meter 164.

Figure 26:
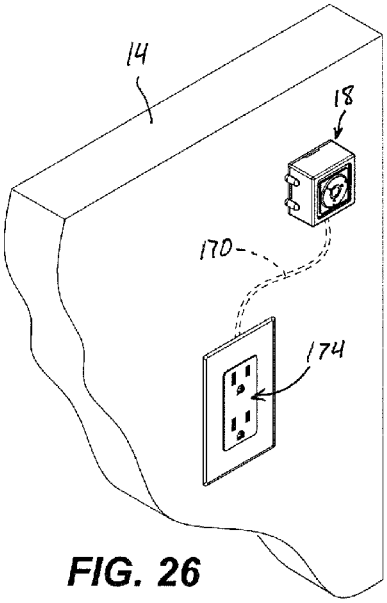
FIGS. 26-28 are perspective views of the power transmitter in different mounting and power supply configurations.
Figure 27:
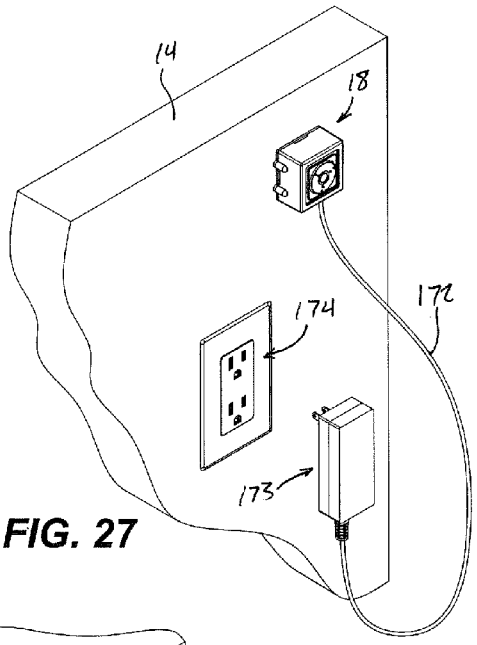
Figure 28:
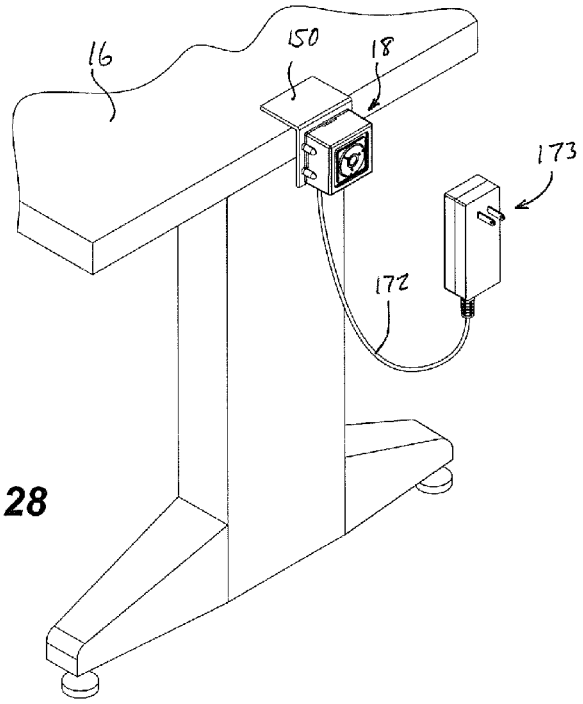

Electrical power may be conveyed to power transmitter 18 in various different ways, such as the hard-wired arrangement of FIG. 1, in which power transmitter 18 is mounted permanently or semi-permanently to an electrical box 166 contained within wall surface 14. For low voltage DC applications, electrical box 166 may contain a DC transformer for converting high-voltage AC power received from a supply line 168 to a suitable DC output voltage, such as between about 5V DC and 12V DC, which is supplied to power transmitter 18. In the alternative, power transmitter 18 may contain appropriate DC transformer circuitry so that the power transmitter is supplied with high-voltage AC power via an AC power supply line 170, which is converted to low-voltage DC power within the power transmitter, such as shown in FIG. 26. In the alternative arrangements of FIGS. 27 and 28, power transmitter 18 is supplied with low-voltage DC power via a low-voltage DC power line 172, which in turn receives low-voltage DC power from a conventional DC transformer 173 with built-in male plug configured to engage a standard AC wall outlet 174 or the like.

Changes and modifications in the specifically-described embodiments may be carried out without departing from the principles of the present invention, which is intended to be limited only by the scope of the appended claims as interpreted according to the principles of patent law including the doctrine of equivalents.

The invention claimed is:

1. An electrical power coupling comprising:

a pair of power coupling parts each having a base configured for mounting to a respective surface, and a coupling portion that is movable relative to said base;

a first electrical contact at each of said coupling portions and spaced laterally outboard a first distance from a center of each of said coupling portions;

a second electrical contact at each of said coupling portions and spaced a second distance laterally outboard from said center of each of said coupling portions, wherein said second distance is greater than said first distance; and a magnetic element in each of said coupling portions, wherein said magnetic elements are attracted to one another when said coupling portions are positioned in close proximity to one another;

wherein each of said coupling portions is configured to move relative to its respective base to thereby align said coupling portions with one another and to establish electrical connections between said first electrical contacts and between said second electrical contacts upon positioning said coupling portions in close proximity.

2. The electrical power coupling of claim 1, wherein said magnetic element of a first of said coupling portions comprises a permanent magnet and said magnetic element of a second of said coupling portions comprises at least one chose from a permanent magnet and a magnetically permeable material.

3. The electrical power coupling of claim 1, wherein a first of said power coupling parts comprises an electrical power transmitter and a second of said power coupling parts comprises an electrical power receiver, said first electrical contact of said electrical power transmitter comprises an outwardly-biased contact pin, and said first electrical contact of said electrical power receiver comprises a circular conductive surface.

4. The electrical power coupling of claim 3, wherein said second electrical contact of said electrical power transmitter comprises an outwardly-biased contact pin, and said second electrical contact of said electrical power receiver comprises a circular conductive surface.

5. The electrical power coupling of claim 4, wherein said first electrical contact of said electrical power transmitter comprises a plurality of said outwardly-biased contact pins spaced circumferentially apart from one another and equidistant from said center, and said second electrical contact of said electrical power transmitter comprises a plurality of said outwardly-biased contact pins spaced circumferentially apart from one another and equidistant from said center.

6. The electrical power coupling of claim 1, wherein said coupling portion of a first of said power coupling parts is pivotable about at least two pivot axes relative to said base of said first of said power coupling parts.

7. The electrical power coupling of claim 6, wherein said coupling portion of said first of said power coupling parts is pivotably coupled to said base of said first of said power coupling parts via pivot pins.

8. The electrical power coupling of claim 6, wherein said coupling portion of a second of said power coupling parts is longitudinally extendable along a longitudinal axis extending through said center of said second of said power coupling parts.

9. The electrical power coupling of claim 8, wherein said two pivot axes are orthogonal to one another, and wherein said longitudinal axis is orthogonal to said two pivot axes.

10. The electrical power coupling of claim 1, further comprising a biasing member in each of said power coupling parts, wherein said biasing member is configured to move or retain a respective one of said coupling portions to a retracted position relative to a respective one of said bases when said coupling portions are disengaged from one another.

11. The electrical power coupling of claim 10, wherein said biasing members comprise at least one chosen from magnets and springs.

12. An electrical power coupling comprising:

a power transmitter having a transmitter base configured for mounting to a first surface, and a power transmission portion coupled to said transmitter base;

a power receiver having a receiver base configured for mounting to a second surface, and a power receiver portion coupled to said receiver base;

at least four electrical contacts, said electrical contacts comprising at least two power transmission contacts at said power transmission portion and at least two power receiver contacts at said power receiver portion and configured to electrically engage respective ones of said at least two power transmission contacts;

a magnetic element in each of said power transmission portion and said power receiver portion, wherein said magnetic elements are attracted to one another when said power transmission portion and said power receiver portion are positioned in close proximity to one another;

wherein at least one of said power transmission portion and said power receiver portion is pivotably coupled to a respective one of said transmitter base and said receiver base to thereby permit said power receiver portion to automatically align with said power transmitter portion and to establish electrical connections between said power receiver contacts and said power transmission contacts upon positioning said power transmission portion and said power receiver portion in close proximity;

wherein at least two of said electrical contacts are arcuately shaped and have respective radii of curvature corresponding to a respective radial distance of each of said arcuately shaped electrical contacts to a center of a respective one of said power transmission portion or said power receiver portion; and wherein at least two others of said electrical contacts are (i) configured and positioned to engage respective ones of said arcuately shaped electrical contacts, and (ii) selectively positionable at different discrete locations that are spaced circumferentially apart along said respective ones of said arcuately shaped electrical contacts when said power receiver is rotated relative to said power transmitter.

13. The electrical power coupling of claim 12, wherein said at least two others of said electrical contacts comprise a first pair of outwardly-biased contact pins that are radially aligned with one another and a second pair of outwardly-biased contact pins that are radially-aligned with one another and spaced circumferentially apart from respective ones of said first pair of said outwardly-biased contact pins.

14. The electrical power coupling of claim 12, wherein a first of said at least two power transmission contacts is spaced laterally outboard by a first distance from a center of said power transmission portion, and a first of said at least two power receiver contacts is spaced laterally outboard by the first distance from a center of said power receiver portion.

15. The electrical power coupling of claim 14, wherein a second of said at least two power transmission contacts is spaced laterally outboard by a second distance from said center of said power transmission portion, and a second of said at least two power receiver contacts is spaced laterally outboard by the second distance from said center of said power receiver portion, and wherein the second distance is greater than the first distance.

16. The electrical power coupling of claim 15, wherein each of said magnetic elements is positioned at said center of each of said power transmission portion and said power receiver portion, wherein at least one of said magnetic elements comprises a permanent magnet and another of said magnetic elements comprises at least one chose from a permanent magnet and a magnetically permeable material.

17. The electrical power coupling of claim 15, wherein said arcuately shaped electrical contacts each comprise a respective circular shape.

18. An electrical power coupling comprising:

a power transmitter having a transmitter base configured for mounting to a first surface, and a power transmission portion coupled to said transmitter base, wherein said power transmission portion is movable relative to said transmitter base;

a power receiver having a receiver base configured for mounting to a second surface, and a power receiver portion coupled to said receiver base, wherein said power receiver portion is movable relative to said receiver base;

at least four electrical contacts, said electrical contacts comprising at least two power transmission contacts at said power transmission portion and at least two power receiver contacts at said power receiver portion and configured to electrically engage respective ones of said at least two power transmission contacts;

wherein at least two of said electrical contacts are arcuately shaped and have respective radii of curvature corresponding to a respective radial distance of each of said arcuately shaped electrical contacts to a center of a respective one of said power transmission portion or said power receiver portion; and wherein at least two others of said electrical contacts are (i) configured and positioned to engage respective ones of said arcuately shaped electrical contacts, and (ii) selectively positionable at different discrete locations that are spaced circumferentially apart along said respective ones of said arcuately shaped electrical contacts when said power receiver is rotated relative to said power transmitter.

19. The electrical power coupling of claim 18, wherein said power transmission portion is pivotably coupled to said power transmitter base, and said power receiver portion is translatably coupled to said power receiver base.

20. The electrical power coupling of claim 18, further comprising a magnetic element in each of said power transmission portion and said power receiver portion, wherein said magnetic elements are configured to attract one another to thereby facilitate establishing direct electrical connections between said at least two power transmission contacts and respective ones of said at least two power transmission contacts.

* * * * *